US006226028B1

(12) United States Patent
Nakahara et al.

(10) Patent No.: US 6,226,028 B1
(45) Date of Patent: May 1, 2001

(54) OPTICAL PRINTER HEAD WHICH PREVENTS DUST FROM BEING GENERATED THEREIN OR ENTERING THEREINTO WHEN IN OPERATION OR DISASSEMBLED

(75) Inventors: Toshiaki Nakahara; Tomohiko Yuge; Hideo Kato; Yuuichi Kimura, all of Mobara (JP)

(73) Assignee: Futaba Denshi Kogyo Kabushiki Kaisha, Mobara (JP)

( * ) Notice: Subject to any disclaimer, the term of this patent is extended or adjusted under 35 U.S.C. 154(b) by 0 days.

(21) Appl. No.: 09/392,652

(22) Filed: Sep. 9, 1999

(30) Foreign Application Priority Data

Sep. 11, 1998 (JP) ..... 10-258742

(51) Int. Cl.[7] ..... B41J 15/14

(52) U.S. Cl. ..... 347/242; 347/241; 347/256; 347/257

(58) Field of Search ..... 347/232, 241, 347/242, 256, 257, 244; 313/496; 359/502; 396/307; 430/245, 511

(56) References Cited

U.S. PATENT DOCUMENTS 4,763,041 * 8/1988 Segawa ..... 313/496
5,870,131 * 2/1999 Yuge et al. ..... 347/232

* cited by examiner

*Primary Examiner*—N. Le
*Assistant Examiner*—Hai C. Pham
(74) *Attorney, Agent, or Firm*—Oblon, Spivak, McClelland, Maier & Neustadt, P.C.

(57) ABSTRACT

An optical printer head capable of preventing catching between a filter holder and a luminous tube to prevent production of dust and attaining replacement of the luminous tube without exposing filters to an ambient atmosphere. A filter holder is arranged separately from a light source and an selfoc lens array, to thereby prevent production of dust from the filter holder due to contact of the filter holder with the light source and selfoc lens array. A base is arranged so as to receive only the filter holder therein, to thereby prevent the filters held on the filter holder from being exposed to an ambient atmosphere, resulting in dust being kept from adhering to the filters. A pair of light passages are formed on a light path and closed with a light-permeable cover to sealedly close the base, to thereby prevent dust from intruding into the base during replacement of the light source.

3 Claims, 8 Drawing Sheets

OPTICAL PRINTER HEAD WHICH PREVENTS DUST FROM BEING GENERATED THEREIN OR ENTERING THEREINTO WHEN IN OPERATION OR DISASSEMBLED

BACKGROUND OF THE INVENTION

This invention relates to an optical printer head, and more particularly to an optical printer head adapted to carry out absorption and transmission of light emitted from a light source through a filter and reflection of the light through a lens, to thereby irradiate it on a photosensitive medium while focusing it thereon, resulting in forming a desired image on the photosensitive medium.

A conventional optical printer adapted to form a desired image on a record medium such as a photosensitive film or the like typically includes a fluorescent luminous tube which is used as a light source. The optical printer is so constructed that light emitted from the fluorescent luminous tube is guided through red, green or blue filters arranged so as to be selectively changeable with each other, to thereby obtain light of the three primary colors, which is then irradiated for writing on a record medium such as a color film or the like, resulting in a full-color image being formed on the record medium.

Now, such a conventional optical printer head will be described with reference to FIGS. 7 to 9, wherein FIG. 7 is an exploded perspective view of the optical printer head and FIGS. 8 and 9 each are a side elevation view in section of the optical printer head. The printer head generally designated at reference numeral 100 includes a fluorescent luminous tube 101 including a plurality of luminous dots for emitting linear light and acting as a light source. Also, it includes a filter holder 102 for holding red, green and blue color filters R, G and B thereon. The thus-constructed fluorescent luminous tube 101 and filter holder 102 are housed or received in a housing 103. Also, the optical printer head 100 includes a selfoc lens array 104 arranged above the housing 103 for forming incident light into an erected real image at an equi-magnification.

The housing 103, as shown in FIG. 8, is formed with an inner space in which the fluorescent luminous tube 101 and filter holder 102 are arranged. The housing 103 is mounted thereon with a bottom plate 106 to close an opening 105 of the space while receiving the fluorescent luminous tube 101 and filter holder 102 in the space. The housing 103 and bottom plate 106 cooperate with each other to provide a box-like base 107. The filter holder 102 is formed thereon with elongated filter holding holes 108 in a manner to extend in a direction perpendicular to a sub-scanning direction indicated at an arrow A in FIG. 8 in which the optical printer head 100 is moved. The color filters R, G and B are held in the filter holding holes 108, respectively.

The fluorescent luminous tube 101 includes a glass plate 101*a*. The filter holder 102 is slid along an upper surface of the glass plate 101*a* and a wall surface of the opening 105 in the direction A or sub-scanning direction, resulting in selective change-over among red, green and blue colors being carried out. The selfoc lens array 104 is formed by constructing a plurality of selfoc lenses into a single module.

However, the optical printer head 100 thus constructed, as shown in FIG. 9, causes an end of the upper surface of the glass plate 101*a* of the fluorescent luminous tube 101 to tend to be caught in the filter holding holes 108 in which the color filters R, G and B are held, when the filter holder 102 is slid in the sub-scanning direction A in FIG. 8 to carry out selective change-over among the color filters R, G and B.

When the filter holder 102 is slid under such circumstances, the filter holder 012 made of a resin material is shaved off to produce shavings or dust. When the thus-produced dust adheres to a surface of the color filters R, G and B, light emitted from the fluorescent luminous tube 101 is kept from satisfactorily permeating through the filters, to thereby fail to permit light to appropriately form an image on a photosensitive film W, leading to a deterioration in quality of the image.

Also, replacement of the fluorescent luminous tube 101 of which a life expired requires to detach the bottom plate 106 from the housing 103, to thereby cause the color filters R, G and B to be exposed to an ambient atmosphere. Such exposure causes dust in an ambient atmosphere to adhere to the color filters R, G and B, resulting in the image quality being further deteriorated.

Referring now to FIG. 10, another conventional optical printer head is illustrated, which is generally designated at reference numeral 110. In FIG. 10, reference characters like those in FIGS. 7 to 9 designate corresponding parts. The optical printer head 110 includes a selfoc lens array 104 arranged in a through-hole 111*a* formed via a central portion of a body 111. The body 111 is provided on a lower portion thereof with a flat section 111*b*, which cooperates with a frame 112 to constitute a housing 113. The selfoc lens array 104 is arranged in a manner to extend through the though-hole 111*a* into the housing 113. The housing 113 has the selfoc lens array 104 and a filter holder 102 received therein while keeping a distal end or outgoing surface 104*a* of the selfoc lens array 104 and one surface of the filter holder 102 facing each other.

The housing 113 is formed with an opening 114, on which a bottom plate 106 is mounted, to thereby provide a box-like base 115. The bottom plate 106 is so arranged that an inner surface 106*a* thereof is opposite to the other surface 102*b* of the filter holder 102. The bottom plate 106 is formed with a hole 106*b* in correspondence to the distal end 104*a* of the selfoc lens array 104. The body 111 is provided at an upper portion thereof with a flange 111*c* formed therein with a hollow section 111*d*. The hollow section 111*d* has a flat surface 111*e*, which is mounted thereon with a fluorescent luminous tube 101 while keeping a glass plate 101*a* abutted thereagainst.

In the thus-constructed optical printer head 110, the filter holder 102 is slid to select any desired one of color filters R, G and B to drive the fluorescent luminous tube 101. In FIG. 10, the color filter G is selected by way of example. Driving of the fluorescent luminous tube 101 permits it to emit light, which is guided through the hollow section 111*d*, to thereby be collected on an incident surface 104*b* of the selfoc lens array 104. The light thus collected is then discharged through the outgoing surface 104*a* of the selfoc lens array 104 and partially absorbed by the color filter G. Light permeating through the color filter G is guided through the hole 106*b* of the bottom plate 106 to a photosensitive plate W, to thereby form an image thereon.

Unfortunately, the optical printer head 110 thus constructed causes the outgoing surface 104*a* of the selfoc lens array 104 to tend to be caught in filter holding holes 108 in which the color filters R, G and B are held, when the filter holder 102 is slid in a sub-scanning direction A to carry out selective change-over among the color filters R, G and B.

When the filter holder 102 is slid in such a state, the filter holder 102 made of a resin material is shaved off to produce shavings or dust. When the thus-produced dust adheres to a surface of the color filters R, G and B, light emitted from the fluorescent luminous tube 101 is kept from satisfactorily permeating through the filters, to thereby fail to permit light to appropriately form an image on the photosensitive film W, leading to a deterioration in quality of the image as in the optical printer head 100 described above with reference to FIGS. 7 to 9.

In addition, when it is desired to clear the outgoing surface 104*a* of the selfoc lens array 104 for maintenance, it is required to detach the bottom plate from the housing 113, to thereby cause the color filters R, G and B to be exposed to an ambient atmosphere. This causes dust in an ambient atmosphere to adhere to the color filters R, G and B, resulting in the image quality being further deteriorated, as in the optical printer head 100 described above.

SUMMARY OF THE INVENTION

The present invention has been made in view of the foregoing disadvantage of the prior art.

Accordingly, it is an object of the present invention to provide an optical printer head which is capable of enhancing quality of an image.

It is another object of the present invention to provide an optical printer head which is capable of preventing production of dust from filter holding means due to contact of the filter holding means with a light source and image formation means.

It is still another object of the present invention to provide an optical printer head which is capable of preventing intrusion of dust thereinto and adhesion of dust to a filter due to interference between the filter and an ambient atmosphere, leading to an increase in quality of an image.

It is yet another object of the present invention to provide an optical printer head which is capable of preventing intrusion of dust thereinto during replacement of a light source.

In accordance with the present invention, an optical printer head is provided. The optical printer head includes a light source arranged so as to be opposite to a record medium and image formation means provided on a light path defined so as to extend from the light source to the record medium. Light emitted from the light source is collected by the image formation means in synchronism with movement relative to the record medium, to thereby form an image on the record medium. The optical printer head also includes filter holding means arranged between the light source and the record medium to hold a plurality of filters thereon and selectively change over any desired one of the filters to position the desired filter on the optical path. The filters each are constructed so as to permit light at a predetermined wavelength emitted from the light source to permeate therethrough. The optical printer head further includes a base formed with light passages so as to be positioned on the light path and arranged so as to receive only the filter holding means therein while keeping it separated from the light source and image formation means. The filter holding means are slidably arranged in the base.

In a preferred embodiment of the present invention, the light passages each are covered with a light-permeable cover to sealedly close the base.

BRIEF DESCRIPTION OF THE DRAWINGS

These and other objects and many of the attendant advantage of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an optical printer head according to the present invention will be described hereinafter with reference to FIGS. 1 to 6.

Figure 1:
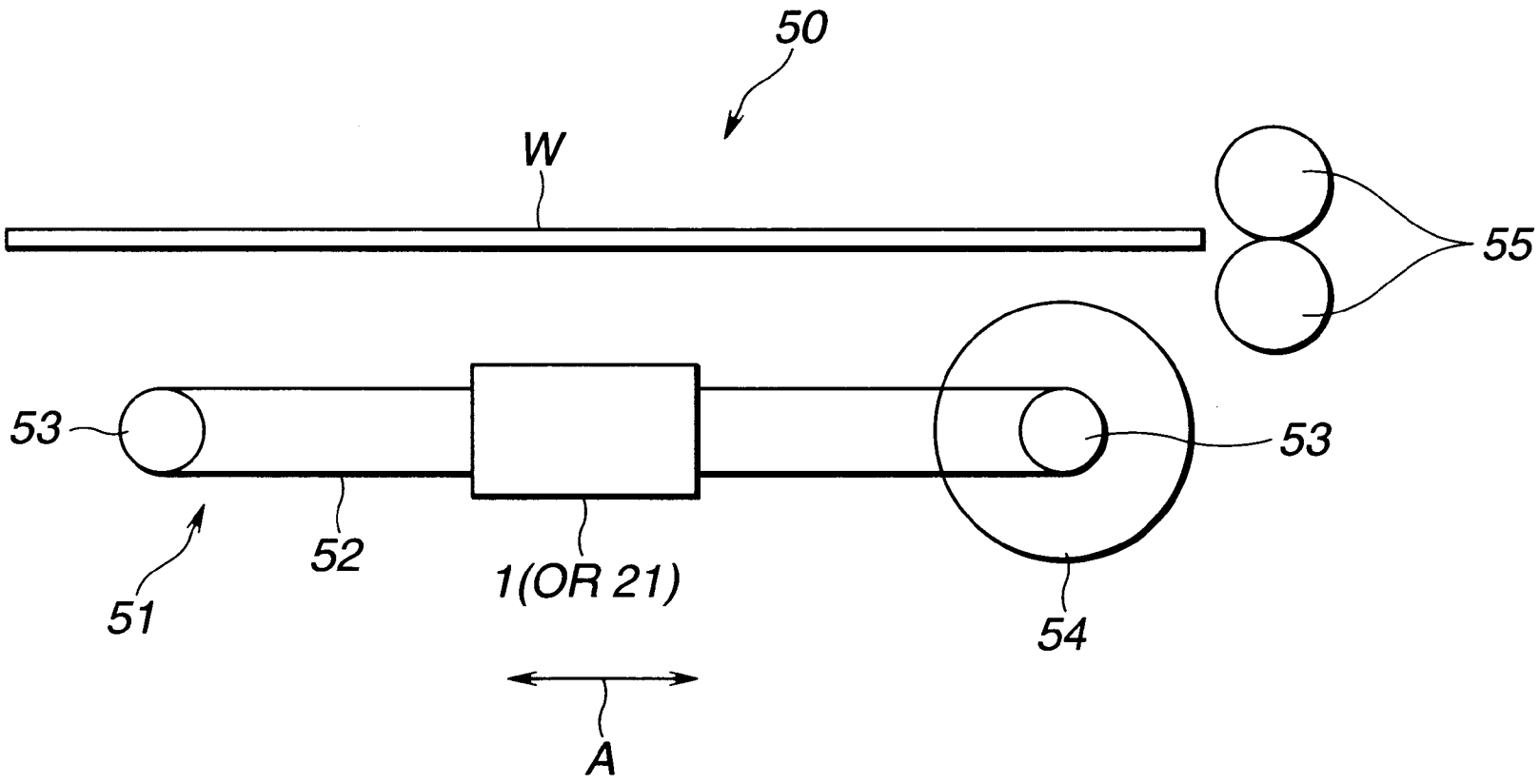
FIG. 1 is a schematic view showing an optical printer to which an optical printer head according to the present invention may be applied by way of example.

Referring first to FIG. 1, an optical printer to which an optical printer head according to the present invention may be applied by way of example, wherein the optical printer and optical printer head are designated at reference numerals 50 and 1 (21), respectively. The optical printer 50 is arranged so as to reciprocate in a sub-scanning direction A with respect to a record medium W such as a color film or the like arranged at a predetermined position by means of transfer means 51. The transfer means 51 includes guide means (not shown) for movably guiding the optical printer head 1 (21) in the sub-scanning direction A, a pair of pulleys 53 on which a drive belt 52 is wound while extending therebetween, and a drive motor 54 for rotating one of the pulleys 53. The optical printer head 1 (21) is fixed on the drive belt 52 and functions to drive the drive motor 54 to circulate the drive belt 52, resulting in being moved in the sub-scanning direction A while being guided by the guide means.

The optical printer head 1 is received or housed in a base (not shown) together with the record medium W constituted by a color film. A plurality of such color films each acting as the record medium W are held at a predetermined position. The color films each are subject to writing by means of light emitted from a fluorescent luminous tube 2 and then outwardly discharged while being interposed between conveyor rollers 55.

Figure 2:
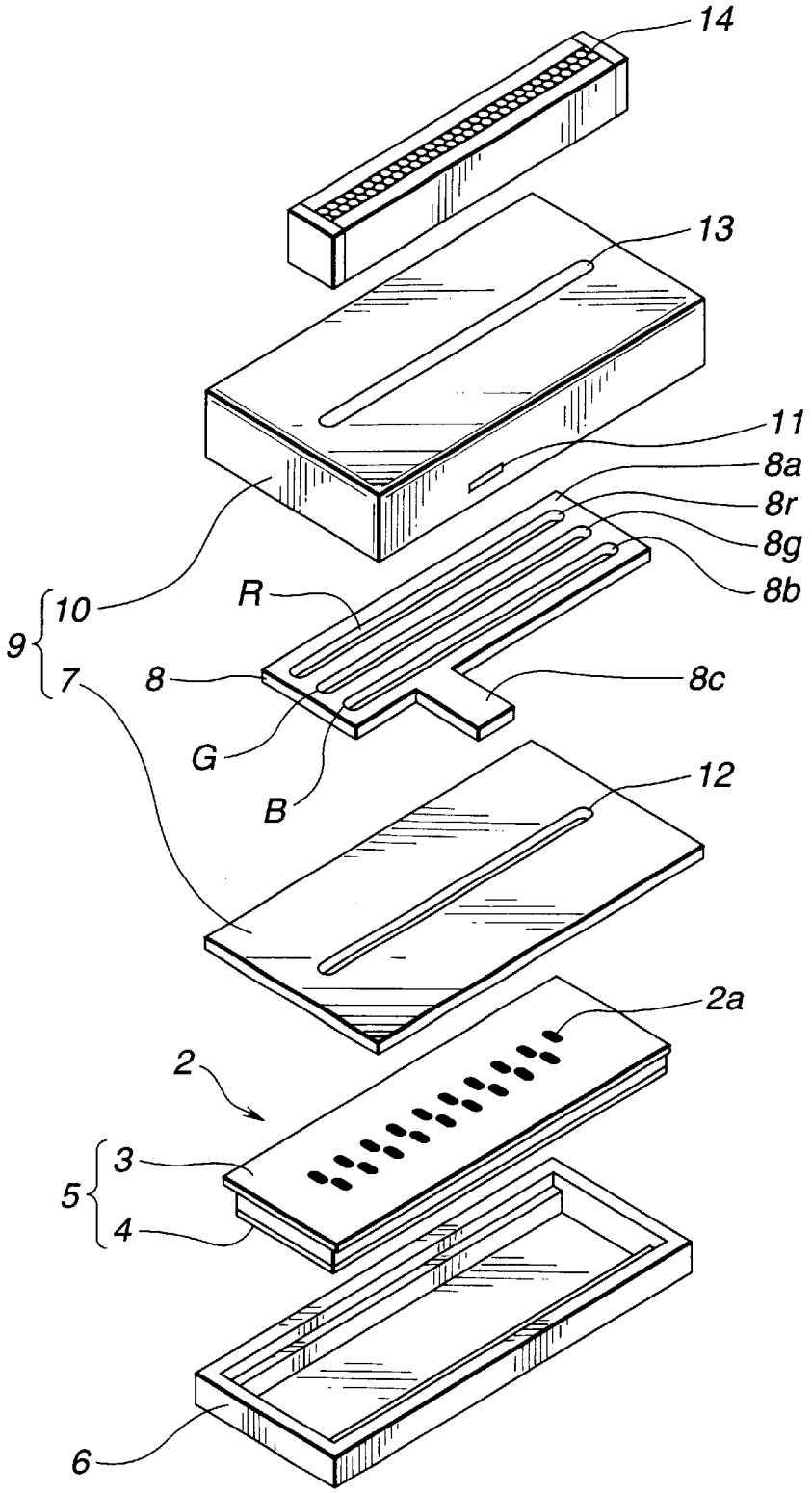
FIG. 2 is an exploded perspective view showing a first embodiment of an optical printer head according to the present invention.
Figure 3:
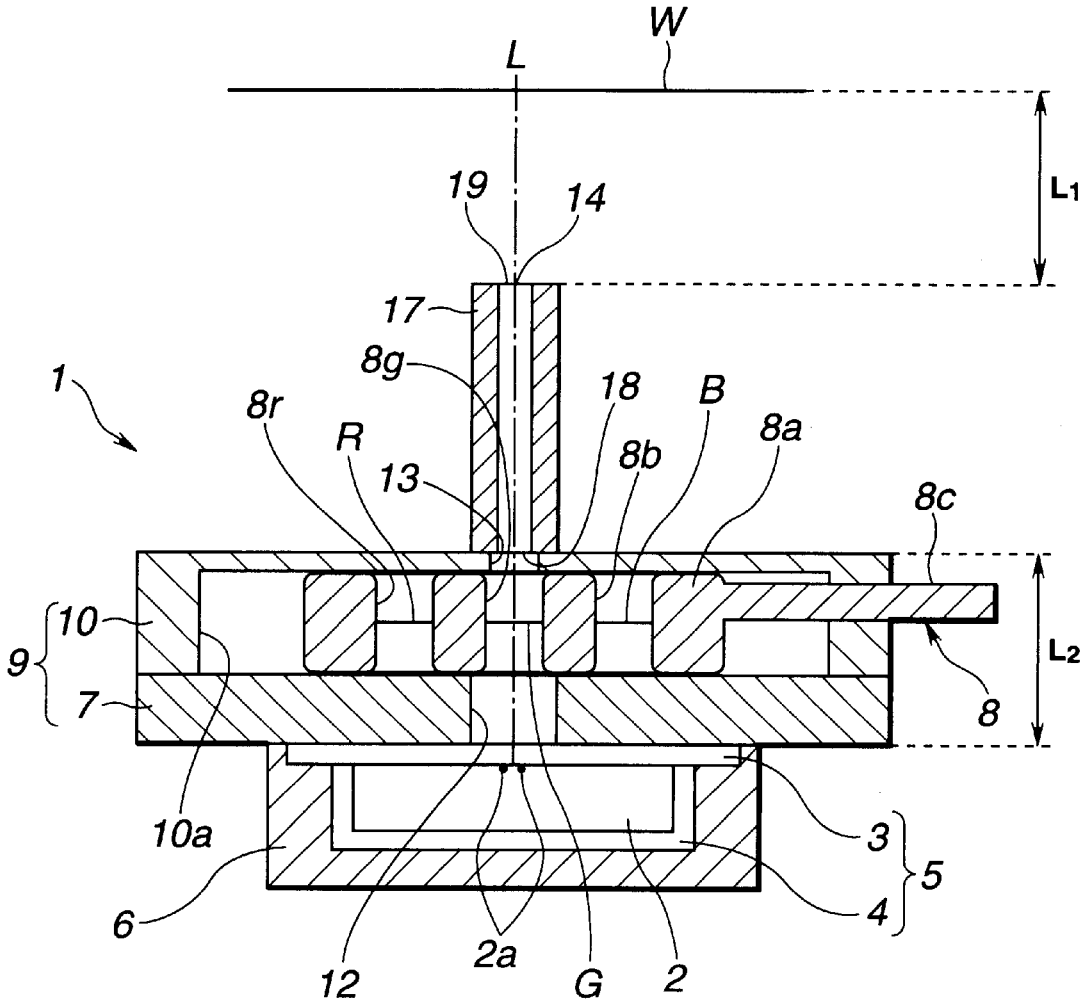
FIG. 3 is a sectional side elevation view of the optical printer head shown in FIG. 2.

Referring now to FIGS. 2 and 3, a first embodiment of an optical printer head according to the present invention is illustrated, wherein an optical printer head of the illustrated embodiment is generally designated at reference numeral 1 and adapted to be mounted on the optical printer 50. The optical printer head 1 includes a fluorescent luminous tube 2 acting as a light source. The fluorescent luminous tube 2 includes an envelope 5 of a substantially rectangular parallelepiped configuration formed by sealedly joining a box-like casing 4 to a light-permeable glass substrate 3 of a rectangular shape. The envelope is evacuated at a high vacuum.

The glass substrate 3 is formed on an inner surface thereof positioned in the envelope 5 with a plurality of anodes each having a phosphor layer deposited thereon, resulting in providing luminous dots 2*a* which are arranged in two rows in an offset or staggered manner. The luminous dots 2*a* each are formed of a phosphor such as, for example, ZnO:Zn into a square shape. The luminous dots 2*a* in each row are arranged in a manner to be spaced from each other at predetermined intervals in a main scanning direction. The fluorescent luminous tube 2 is received in a frame-like container 6 for the fluorescent luminous tube 2.

The luminous tube container 6, as shown in FIG. 3, is fixedly mounted on an upper surface thereof formed with an opening with a filter holder guide 7 using fixing means such as, for example, screws or the like while receiving the fluorescent luminous tube 2 therein. The filter holder guide 7 is constituted by a flat substrate or plate. The filter holder guide 7 is formed on a central portion thereof with a light passage 12 in the form of a hole. The light passage 12 is formed at an outer peripheral edge thereof into a shape like a curved surface.

The filter holder guide 7 is provided thereon with a filter holder 8 made of a resin material and acting as filter holding means. The filter holder 8 is constituted by a flat section 8*a* and an operation element 8*c*. The flat section 8*a* is formed thereon with three elongated filter holding holes 8*r*, 8*g* and 8*b* in a manner to extend in a direction of arrangement of the luminous dots 2*a* or the main scanning direction while being kept parallel to each other. The filter holding holes 8*r*, 8*g* and 8*b* have color filters R, G and B held therein, respectively. The color filters R, G and B each are constructed so as to permit light at a predetermined wavelength to permeate therethrough. The filter holding holes 8*r*, 8*g* and 8*b* each are formed at an outer peripheral edge thereof into configuration like a curved surface. The operation element 8*c* is connected to a drive mechanism (not shown), to thereby slide the filter holder 8 in the sub-scanning direction A.

The filter holder 8 is received in a base 9, which is constituted by a housing 10 of a box-like shape and the filter holder guide 7 mounted on an opening of the housing 10. The housing 10 has a side surface 10*a* acting to regulate a width of sliding of the filter holder 8. The housing 10 is formed on one side surface thereof with a hole 11 through which the operation element 8*c* of the filter holder 8 is inserted. The filter holder 8 is abutted on one side surface thereof against a bottom surface of the housing 10 and the other side surface thereof against the filter holder guide 7. The housing 10 is provided at a central portion of the bottom surface thereof with a light passage 13 in the form of a hole in a manner to correspond to the luminous dots 2*a* of the fluorescent luminous tube 2 and form a pair in cooperation with the light passage 12. The light passage 13 is formed at an outer peripheral edge thereof into a shape like a curved surface.

A selfoc lens array 14 which functions as image forming means for forming light into an image is an optical device formed by integrating a plurality of substantially cylindrical selfoc lenses 16 in correspondence to the luminous dots 2*a* while rendering central axes thereof parallel to each other. The selfoc lens array 14 has a plurality of frame plates 17 fixed on an outer periphery thereof. The selfoc lens array 14 is so arranged that one surface 18 thereof or an incident surface thereof faces the light passage 13 of the housing 10, resulting in light emitted from the fluorescent luminous tube 2 being introduced thereto. The selfoc leans array 14 also has the other surface or an outgoing surface 19 arranged opposite to the record medium or color film W. The selfoc lens array 14 permits light which travels in each of the lenses 16 while meandering at a constant cycle to be emitted from the outgoing surface 19, to thereby form an image on the color film W.

The selfoc lens array 14 is provided thereon with the color film W in a manner to extend in the sub-scanning direction A. In order to obtain optimum resolution, a distance L1 between the outgoing surface 19 of the selfoc lens array 14 and a distance L2 between the incident surface 18 of the selfoc lens array 14 and the luminous tube 2 are set to be equal to each other.

Now, the manner of operation of the optical printer head of the illustrated embodiment will be described with reference to FIGS. 1 and 3. In the following description, a plane along which light emitted from the luminous dots 2*a* arranged in the main scanning direction reaches the color film W through the light passages 12 and 13 in a pair and the selfoc lens array 14 will be referred to as a light path L.

First, a drive motor 54 is driven to circulate a drive belt 52, so that the optical printer head 1 fixed on the drive belt 52 may be moved in the sub-scanning direction A. Concurrently, the filter holder 8 is slid in the sub-scanning direction A perpendicular to the light path L by means of a drive mechanism (not shown) connected to the operation element 8*c*, resulting in any desired one of the color filters R, G and B being set on the light path L. In FIG. 3, the color filter G is set. The filter holder 8 is abutted on one surface thereof against the bottom surface of the housing 10 and abutted on the other surface thereof against the filter holder guide 7, so that the filter holder 8 may be slid in the sub-scanning direction A while being interposed between the bottom surface of the housing 10 and the filter holder guide 7. This prevents the filter holding holes 8*r*, 8*g* and 8*b* of the filter holder 8 from being caught on the fluorescent luminous tube 2, to thereby keep the filter holder 8 from being shaved, unlike the prior art.

The filter holding holes 8*r*, 8*g* and 8*b* of the filter holder 8 and the light passages 12 and 13 in a pair each are formed at the outer peripheral edge thereof into a curved surface-like shape as described above, to thereby prevent catching between the filter holding holes 8*r*, 8*g* and 8*b* and the light passages 12 and 13, resulting in ensuring smooth movement of the filter holder 8.

When any desired color filter (the color filter G in FIG. 3) is set on the light path L as described above, a drive signal is inputted to the luminous dots 2*a* of the fluorescent luminous tube 2, leading to luminescence of any desired luminous dots 2*a*.

Light emitted from the luminous dots 2*a* of the fluorescent luminous tube 2, as shown in FIG. 3, is guided through the light passage 12, to thereby be incident on the color filter G set on the light path L as described above, so that a part of the light is absorbed by the color filter G. The remaining light permeating through the color filter G is guided through the light passage 13, to thereby be incident on the incident surface of the selfoc lens array 14. The incident light travels in each of the selfoc lenses 16 while meandering at a constant cycle and then is emitted from the outgoing surface, to thereby form an image on the color film W while being maintained as emitted. The above-described operation is likewise carried out when the color filter R or B is set on the light path L. Then, the color film W is outwardly discharged while being interposed between carrier rollers 25 after it is subject to writing using light emitted from the fluorescent luminous tube 2.

A phosphor for the luminous dots 2*a* is constituted by ZnO:Zn, which is considerably increased in emission spectrum. Thus, the printer head 1 permits dot-like light of each of red, green and blue to be irradiated on the color film W by means of the color filters R, G and B and permits an erected real image at an equi-magnification to be formed on the color film W.

Also, when it is desired to replace the fluorescent luminous tube 2 of which a life expired due to long-term use, the luminous tube container 6 is released from fixing on the filter holder guide 7 to remove the luminous tube container 6 from the filter holder guide 7, followed by replacement of the luminous tube container with a new one. This permits only the light passage 12 to be exposed to an ambient atmosphere during the replacement, to thereby substantially reduce adhesion of dust to the color filters R, G and B.

Figure 4:
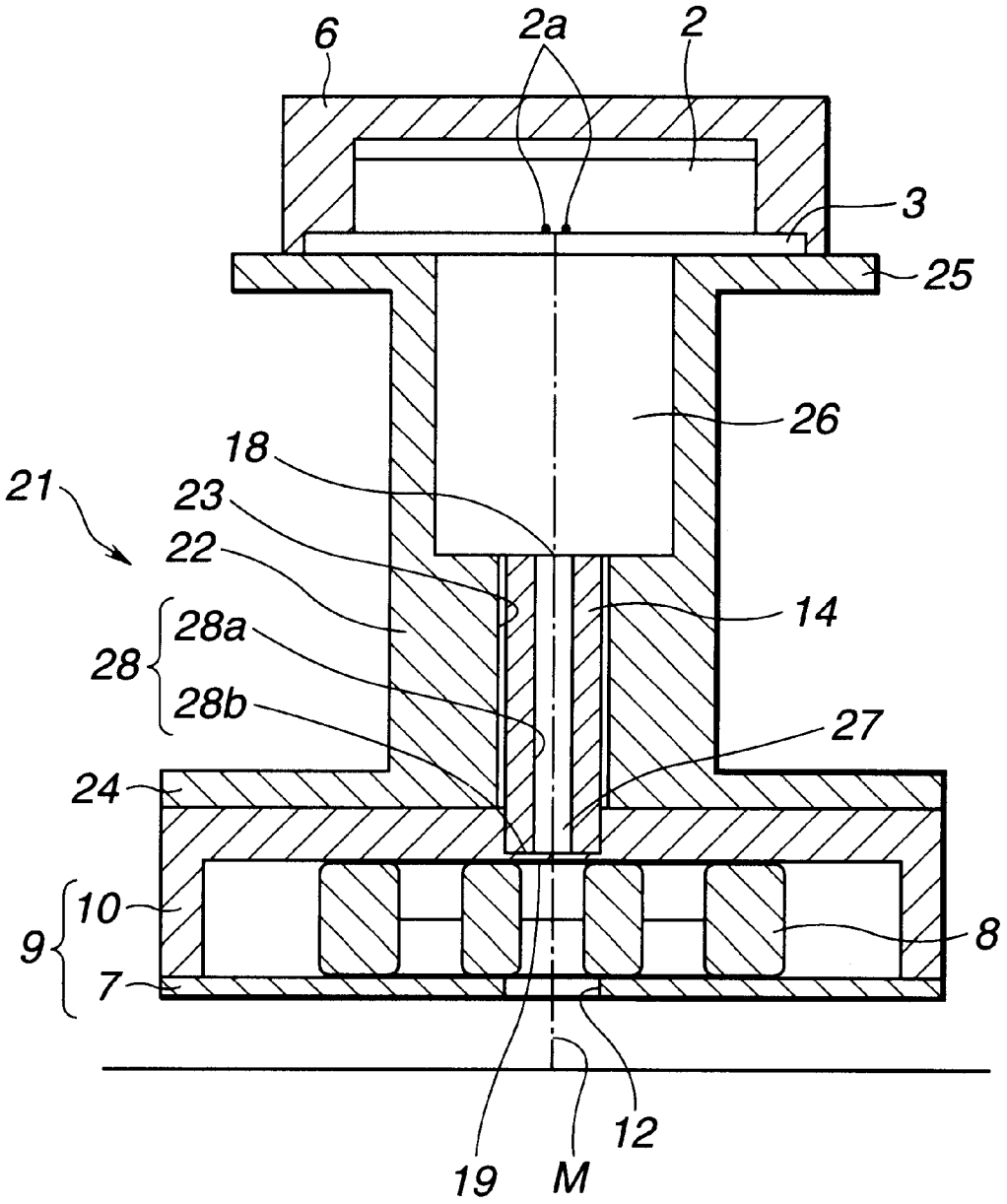
FIG. 4 is a vertical sectional side elevation view showing a second embodiment of an optical printer head according to the present invention.
Figure 5:
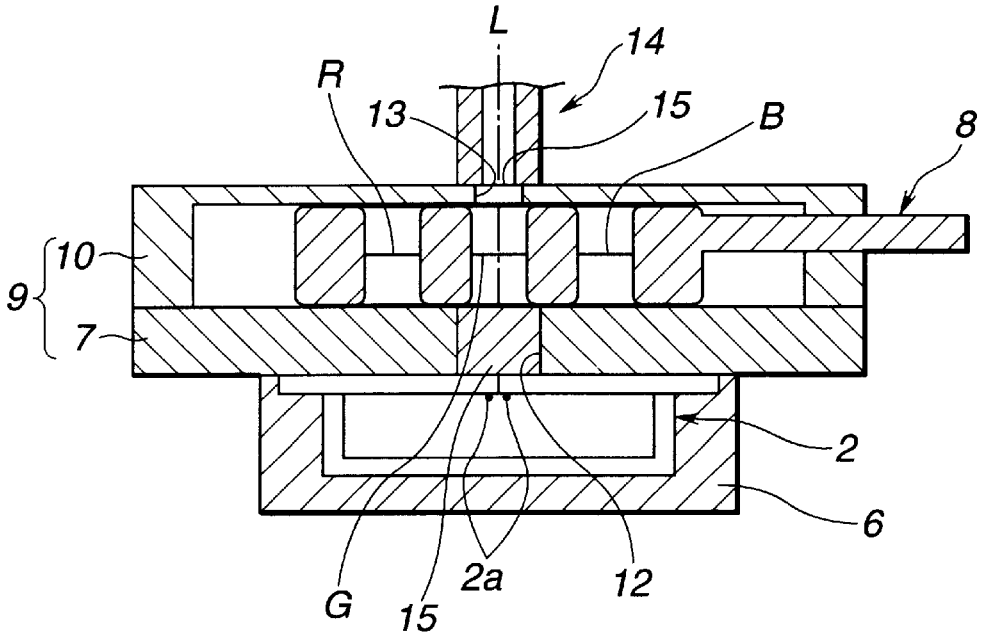
FIG. 5 is an enlarged sectional side elevation view showing a modification of the optical printer head shown in FIG. 2.
Figure 6:
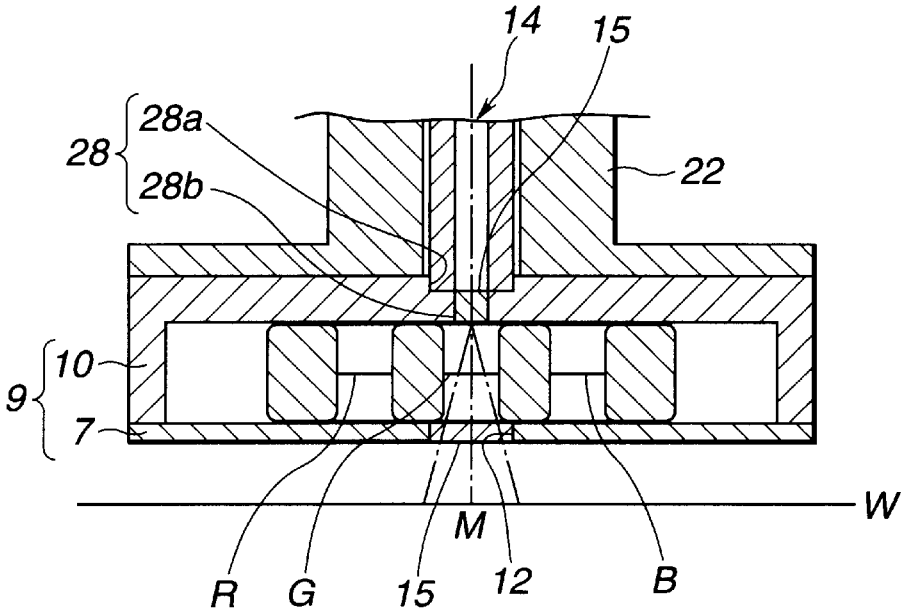
FIG. 6 is an enlarged sectional side elevation view showing a modification of the optical printer head shown in FIG. 4.
Figure 7:
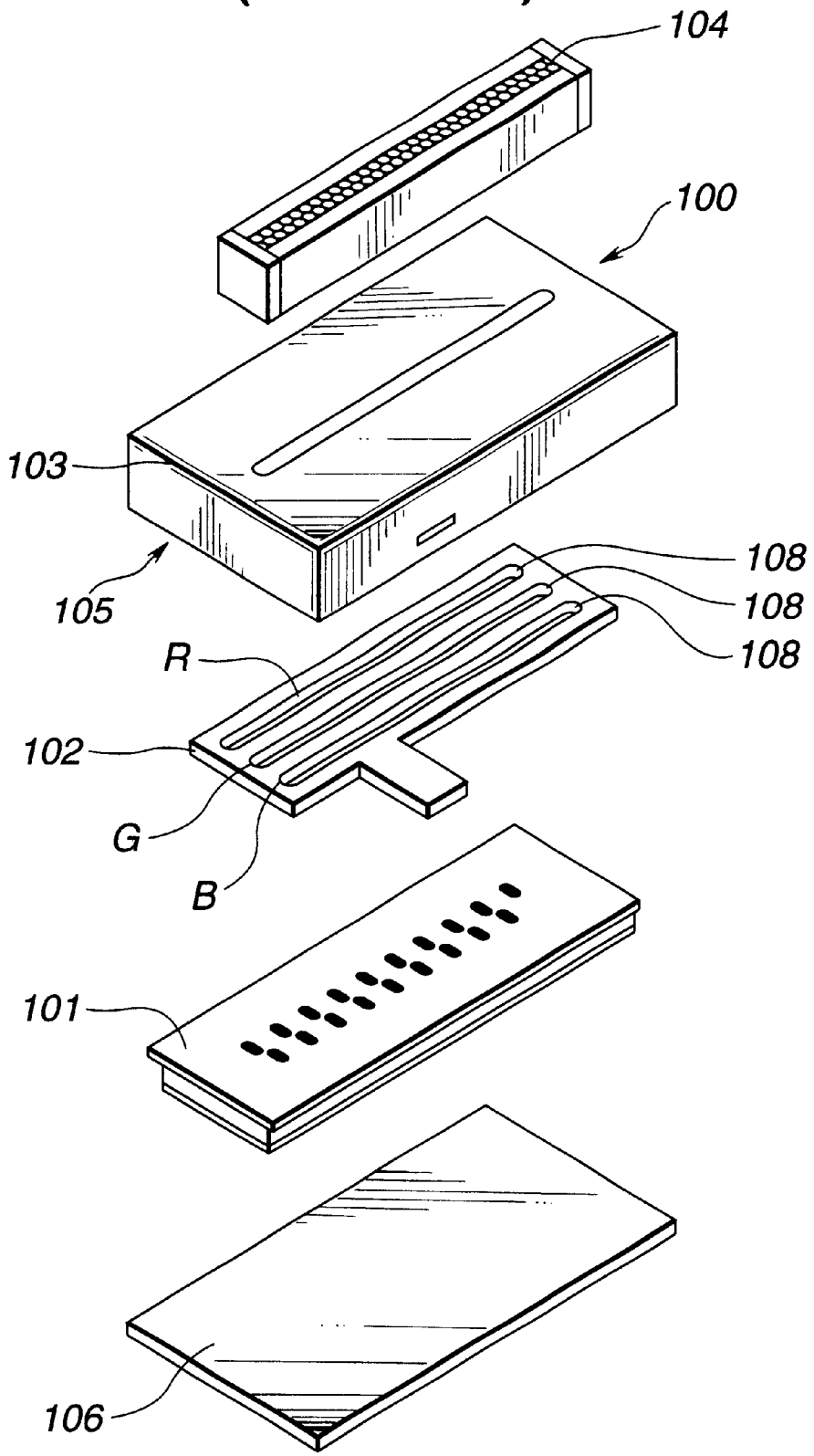
FIG.7 (PRIOR ART)
FIG. 7 is an exploded perspective view showing a conventional optical printer head.
Figure 8:
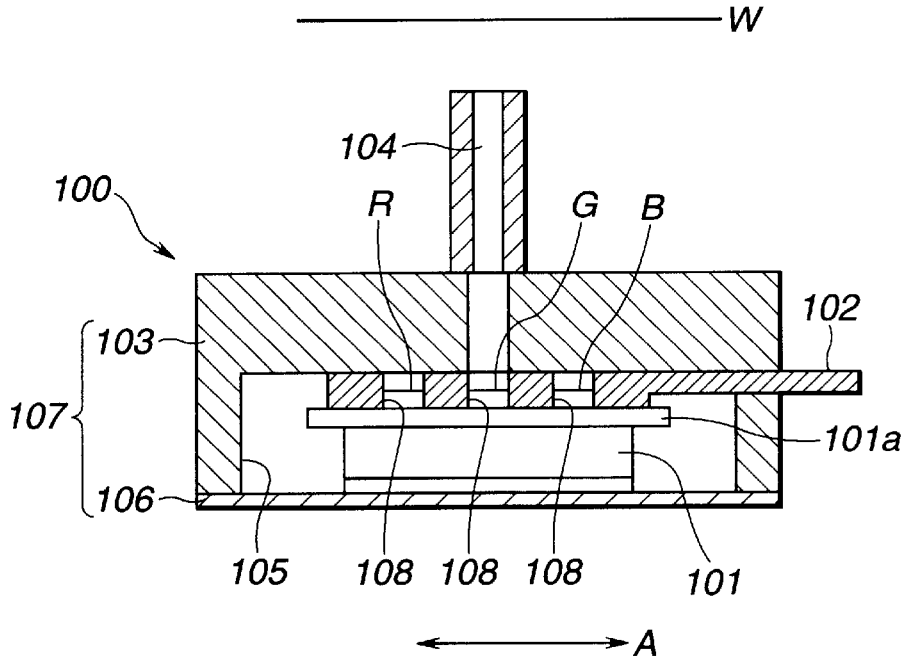
FIG.8 (PRIOR ART)
FIG. 8 is a sectional side elevation view of the optical printer head shown in FIG. 7.
Figure 9:
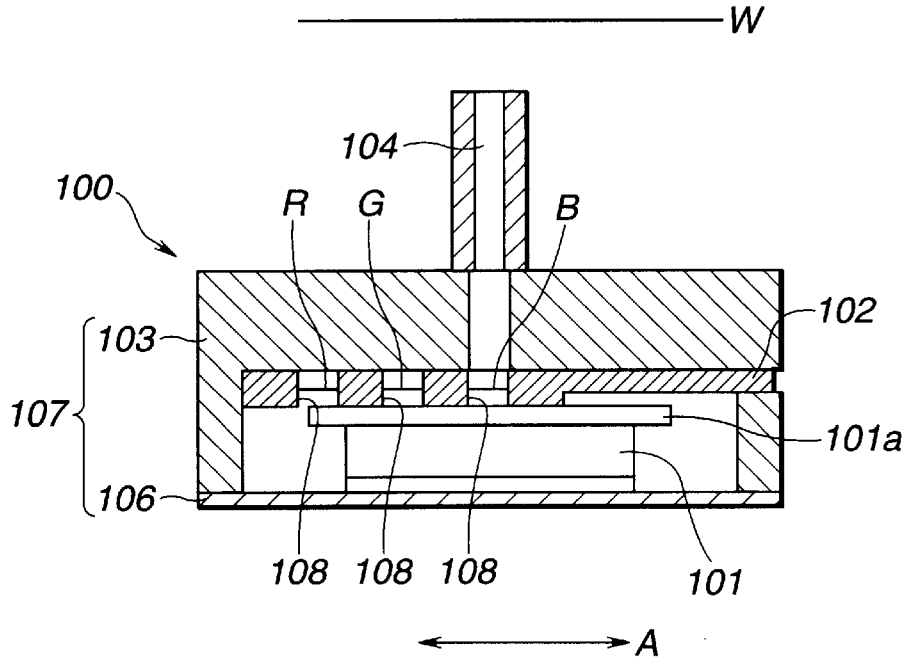
FIG.9 (PRIOR ART)
FIG. 9 is a sectional side elevation view showing operation of the optical printer head shown in FIG. 7.
Figure 10:
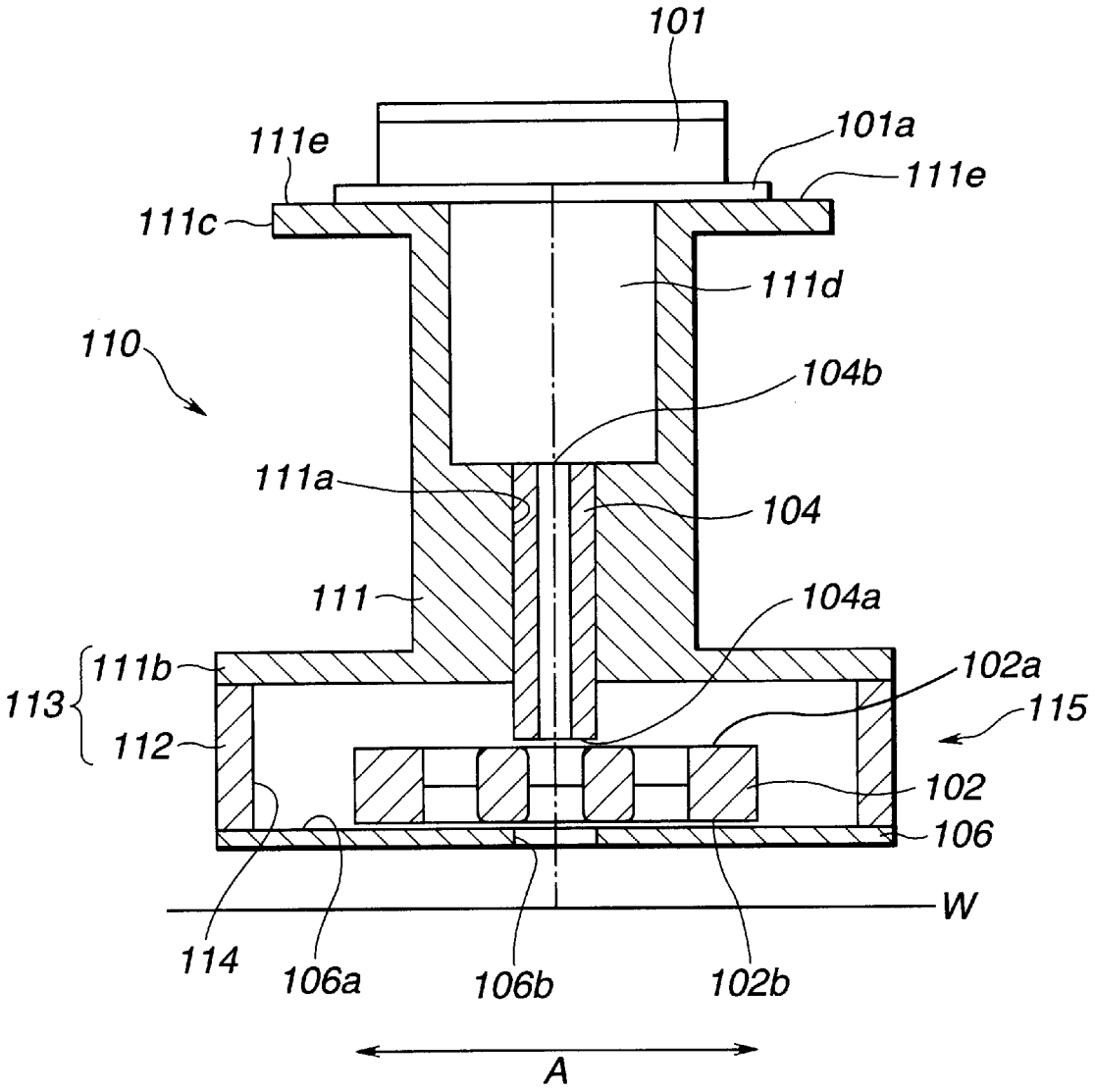
FIG.10 (PRIOR ART)
FIG. 10 is a sectional side elevation view showing another conventional optical printer head.

Referring now to FIG. 4, a second embodiment of an optical printer head according to the present invention is illustrated. In FIG. 4, reference characters like those in FIGS. 1 to 3 designate corresponding parts. In the following description, a plane along which light emitted from a fluorescent luminous tube 2 or luminous dots 2*a* reaches a color film W will be referred to as a light path M.

An optical printer head of the illustrated embodiment generally designated at reference numeral 21 includes a body 22 for organically coupling the fluorescent luminous tube 2, selfoc lenses 14 and a base 9 to each other. The body 22 is formed at a central portion thereof with a lens insertion hole 23 in a manner to be positioned on the light path M. The lens insertion hole 23 has a selfoc lens array 14 inserted therein. The selfoc lens array 14 has a distal end 27 projected from a flat section 24 of the body 22 provided at a lower portion thereof and inserted into a light passage 28. The body 22 is so arranged that the flat section 24 of the body 22 is joined to a bottom surface of a housing 10.

The body 22 is formed at an upper portion thereof with a flange 25 provided therein with a hollow section 26. The flange 25 has a flat surface section, which is mounted thereon with the fluorescent luminous tube 2 while keeping a glass substrate 3 of the fluorescent luminous tube 2 abutted against the flat surface section.

A base 9 is constituted by the housing 10 of a box-like shape formed with an opening and a filter holder guide 7 made of a resin material and mounted on the opening of the housing 10, as in the first embodiment described above. The base 9 has a filter holder 8 housed therein. The base 9 is formed with a pair of light passages 12 and 28 in the form of a hole in correspondence to a whole width of the luminous dots 2*a* of the fluorescent luminous tube 2 in a row direction thereof in a manner to be positioned on the light path M. The light passage 12 is formed at a central portion of the filter holder guide 7 so as to extend in a main scanning direction.

The light passage 28 is formed at a central portion of the bottom surface of the housing 10 in a manner to extend in the row direction of the luminous dots 2*a* or the main scanning direction. The light passage 28, as shown in FIG. 4, includes a diameter-increased hole 28*a* and a diameter-reduced hole 28*b* formed integrally with each other in a manner to communicate with each other in a thickness direction of the bottom surface of the housing 10. The selfoc lens array 14 is inserted at the distal end 27 thereof into the diameter-increased hole 28*a*.

Now, the manner of operation of the optical printer head of the illustrated embodiment will described with reference to FIGS. 1 and 4.

First, a drive motor 54 is driven to circulate a drive belt 52, so that the optical printer head 21 fixed on the drive belt 22 may be moved in the sub-scanning direction A. At the same time, the filter holder 8 is slid in a direction perpendicular to the light path M by means of a drive mechanism (not shown) connected to an operation element 8*c*, resulting in any desired one of color filters R, G and B being set on the light path M.

The filter holder 8 is abutted on one surface thereof against the bottom surface of the housing 10 and abutted on the other surface thereof against the filter holder guide 7, so that the filter holder 8 may be slid in the sub-scanning direction A while being interposed between the bottom surface of the housing 10 and the filter holder guide 7. This prevents filter holding holes 8*r*, 8*g* and 8*b* of the filter holder 8 from being caught on the fluorescent luminous tube 2, to thereby keep the filter holder 8 from being shaved.

When any desired color filter (the color filter G in FIG. 4) is set on the light path M as described above, a drive signal is inputted to the luminous dots 2*a* of the fluorescent luminous tube 2, leading to luminescence of any desired luminous dots 2*a*.

Light emitted from the luminous dots 2*a* of the fluorescent luminous tube 2, as shown in FIG. 4, is guided through the hollow section 26 of the body 22, to thereby be incident on an incident surface 18 of the selfoc lens array 14. The incident light then travels in each of the selfoc lenses 16 while meandering at a constant cycle and then is emitted from the outgoing surface 19. Then, the light is guided through the light passage 28, to thereby be incident on the color filter G set on the light path M, resulting in a part of the light being absorbed by the color filter G. The remaining light permeating through the color filter G is guided through the light passage 12, to thereby form an image on the color film W while being maintained as emitted. The above-described operation is likewise carried out when the color filter R or B is set on the light path L. Then, the color film W is outwardly discharged while being interposed between carrier rollers 25 after it is subject to writing using light emitted from the fluorescent luminous tube 2.

As in the first embodiment described above, a phosphor for the luminous dots 2*a* is constituted by ZnO:Zn, which is considerably increased in emission spectrum. Thus, the printer head 1 permits dot-like light of each of red, green and blue to be irradiated on the color film W by means of the color filters R, G and B and an erected real image at an equi-magnification to be formed on the color film W.

In each of the embodiments described above, a fluorescent luminous tube is used as the light source 2, however, the light source is not limited to such a fluorescent display device. A field emission display device, an organic EL device or the like may be suitably used for this purpose.

Also, in each of the embodiments, the light path L or M is formed into a straight line. Alternatively, a mirror or the like is arranged on the light path L or M while being inclined at a predetermined angle, to thereby refract the light path.

Further, the embodiments described above, as shown in FIGS. 5 and 6, each are so constructed that the light passages 12 and 13 (diameter-reduced hole 28*b*) is formed with a light-permeable cover 15 such as glass or the like. Such construction permits the base 9 to be kept closed during replacement of the fluorescent luminous tube 2 or maintenance of the selfoc lens array 14. This prevents adhesion of dust to the color filters R, G and B, to thereby further increase quality of an image.

As can be seen from the foregoing, in the optical printer head of the present invention, the filter holding means are arranged separately from the light source and image formation means. This prevents production of dust from the filter holding means due to contact of the filter holding means with the light source and image formation means, to thereby enhance quality of an image formed.

Also, the base has only the filter holding means housed therein, to thereby prevent the filters from being exposed to an ambient atmosphere, resulting in dust being kept from adhering to the filters, leading to a further improvement in image quality.

In addition, the paired light passages formed on the light path are closed with the light-permeable cover, resulting in the base being sealedly closed. This prevents dust from intruding into the base during replacement of the light source.

While preferred embodiments of the invention have been described with a certain degree of particularity with reference to the drawings, obvious modifications and variations are possible in light of the above teachings. It is therefore to be understood that within scope of the appended claims, the invention may be practiced otherwise than as specifically described.

What is claimed is:

1. An optical printer head comprising:

a light source arranged so as to be opposite to a recording medium;

image formation means provided on a light path defined so as to extend from said light source to said recording medium;

said light source emitting light, said light being collected by said image formation means as said optical printer head is being reciprocated in a sub-scanning direction with respect to said recording medium, to thereby form an image on said recording medium; and filter holding means arranged between said light source and said recording medium to hold a plurality of filters thereon and selectively change over a desired filter of said plurality of filters to position said desired filter on said light path;

each of said plurality of filters being constructed so as to permit said light, which is at a predetermined wavelength and which is emitted from said light source, to permeate therethrough; and a base enclosing said filter holding means, said base including a housing and a filter holder guide each having an elongated light passage therethrough so that said light passage of said filter holder guide is aligned with said light passage of said housing in a direction of elongation of said light passages, said base being positioned on said light path and arranged so as to receive said filter holding means therein so as to keep said filter holder means separated from said light source and image formation means;

said filter holding means being slidably arranged in said base.

2. The optical printer head as defined in claim 1, wherein said light passages each are covered with a light-permeable cover to sealedly close said base.

3. An optical printer head comprising:

a light source arranged so as to be opposite to a recording medium;

image formation means provided on a light path defined so as to extend from said light source to said recording medium;

said light source emitting light, said light being collected by said image formation means as said optical printer head is being reciprocated in a sub-scanning direction with respect to said recording medium, to thereby form an image on said recording medium; and filter holding means arranged between said light source and said recording medium to hold a plurality of filters thereon and selectively change over a desired filter of said plurality of filters to position said desired filter on said light path;

each of said plurality of filters being constructed so as to permit said light, which is at a predetermined wavelength and which is emitted from said light source, to permeate therethrough; and a base formed with light passages so as to be positioned on said light path and arranged so as to receive only said filter holding means therein, while keeping said filter holder means separated from said light source and image formation means, said filter holding means being slidably arranged in said base, and said light passages each being covered with a light-permeable cover for sealedly closing said base to prevent dust from entering into said optical printer head.

* * * * *